73-151 SR
12/23/86 XR 4,631,677

United States Patent [19]
Park et al.

[11] Patent Number: 4,631,677
[45] Date of Patent: Dec. 23, 1986

[54] METHOD FOR DETERMINING THE PLACEMENT OF PERFORATIONS IN A WELL CASING

[75] Inventors: Arthur Park, Odessa; Bob T. Wilson, Midland, both of Tex.

[73] Assignee: Diamond Oil Well Drilling Company, Midland, Tex.

[21] Appl. No.: 616,410

[22] Filed: Jun. 1, 1984

[51] Int. Cl.[4] ..... G01V 1/00; G01N 15/08; E21B 49/00

[52] U.S. Cl. ..... 364/422; 364/420; 73/38; 73/151; 73/152; 73/155; 324/376

[58] Field of Search ..... 364/422, 420; 250/253, 250/256; 73/38, 151, 152, 153, 155; 175/59, 40; 324/376; 367/31, 35

[56] References Cited

U.S. PATENT DOCUMENTS

| | | | |
|---|---|---|---|
| 4,312,414 | 1/1982 | Park | 175/50 X |
| 4,420,975 | 12/1983 | Nagel et al. | 73/155 |
| 4,429,221 | 1/1984 | Allen | 250/256 |
| 4,432,077 | 2/1984 | Alhilali et al. | 367/31 |
| 4,467,642 | 8/1984 | Givens | 73/152 |
| 4,506,542 | 3/1985 | Rose et al. | 73/38 |
| 4,555,934 | 12/1985 | Freeman et al. | 73/38 |
| 4,561,289 | 12/1985 | Jones et al. | 73/38 |
| 4,573,342 | 3/1986 | Jones et al. | 73/38 |
| 4,575,828 | 3/1986 | Williams et al. | 367/31 |

*Primary Examiner*—Jerry Smith
*Assistant Examiner*—Charles B. Meyer
*Attorney, Agent, or Firm*—Jerry W. Mills; Gregory M. Howison

[57] ABSTRACT

A method for determining the productivity of a well site includes extracting a core with sponge coring techniques and measuring the parameters of the core. The parameters measured are porosity, permeability and percent mobile oil. A core factor is calculated which is the square root of the product of permeability and porosity and indicates the space available in the core for oil production. The core factor is multiplied by the percent mobile oil to provide a Production Index. The Production Index indicates the capacity of a given oil well to produce oil. With the Production Index data, perforations are selectively placed in various areas along the longitudinal axis of a well casing (38) to selectively allow communication between the interior of the well casing and a formation of interest. In this manner, only areas having high oil mobility are communicated within a given region of the formation of interest.

13 Claims, 6 Drawing Figures

METHOD FOR DETERMINING THE PLACEMENT OF PERFORATIONS IN A WELL CASING

TECHNICAL FIELD OF THE INVENTION

The present invention pertains to placement of perforations in a well casing that is lowered into a predrilled well and, more particularly, to a method for more exactly defining the relative producibility of the areas along the longitudinal axis of the casing within a formation of interest.

BACKGROUND OF THE INVENTION

In order to maximize production of a given drilling operation, it is first necessary to determine whether a given region passed through during the drilling process has a high quantity of oil and/or gas contained therein. This region is termed the "formation of interest." Secondly, it is necessary to efficiently extract the oil and/or gas therefrom. One problem that is incurred in efficiently extracting oil and/or gas from a well that is determined to be productive is the mixing of salt water with the oil and/or gas. The presence of high levels of salt water in the formation requires additional steps for removal thereof in addition to the increased energy requirements to pump the water.

To determine the potential of a given well, a core sample is normally taken from the formation of interest. This extracted core is analyzed to determine various properties thereof such as porosity, permeability and oil saturation. From these properties, a determination can be made as to whether this particular region will produce a sufficient amount of oil and/or gas to warrant a pumping operation. If the determination is made that the well has a high probability of being productive, a well casing is then lowered into the well to provide a conduit for retracting fluids therefrom. After the well casing has been lowered, a special device is lowered into the well that carries an explosive charge for selected perforation of the casing. This apparatus is lowered to a predetermined depth and then discharged to perforate the well casing at that depth resulting in perforations along a selected segment that are spaced in predetermined depth increments. If pressure in the formation is of sufficient magnitude, the oil and/or gas will flow freely to the surface for extraction thereof. However, if this pressure is not sufficient, a pump must be installed for extraction purposes.

The first problem of determining whether the formation of interest will have a high production rate is to determine the amount of oil present in each foot-acre. This determination has been simplified with sponge coring techniques disclosed in U.S. Pat. No. 4,312,414, issued to Arthur Park, one of the present Applicants. Sponge coring enables a drilling company to determine a more accurate profile of the characteristics of a given core sample along its longitudinal axis at the various depths and the amount of oil contained within the pore space of the sample core. From this information, conventional techniques are then applied to determining where the perforations are to be placed. It is quite important to place these perforations at the correct points along the formation of interest in order to maximize the production. Although oil and/or gas may be contained in a given region, the flow of oil from this point may be impeded due to undesirable characteristics of a formation, and the undesirable characteristics may exist at certain portions of a given region.

In order to maximize production levels, there exists a need for an improved method of determining the predicted productivity of a potential well and placing the perforations in the well casing as a function of the data derived from present day coring techniques such as sponge coring.

SUMMARY OF THE INVENTION

A method for determining the productivity of a well site includes first extracting a representative core sample from the well site of a formation of interest. The porosity and permeability of the core sample are then measured at predetermined depth increments. A measurement is then made of the fraction of the pore volume in the core sample that is occupied by oil at each of the predetermined increments. A measurement is then made of the fraction of the pore volume in the sponge sample that is occupied by oil at each of the predetermined increments. The total oil is equal to the oil remaining in the core on the surface of the well in addition to the oil that bleeds out of the core sample upon extraction thereof and absorbed by the sponge sample, the fraction equal to the percent mobile oil. A Production Index is then determined to indicate the producibility of a well as a function of depth increments. The Production Index varies directly with the product of the porosity, permeability and percent mobile oil.

In an alternate embodiment of the present invention, perforations are placed at various locations depending upon the values of the Production Index. If the Production Index is greater than a predetermined value or threshold, perforations are placed in this region whereas a value lower than the predetermined threshold indicates a point where perforations should not be placed. Selective placing of perforations in accordance with the Production Index data results in higher productivity for a given well site.

DETAILED DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
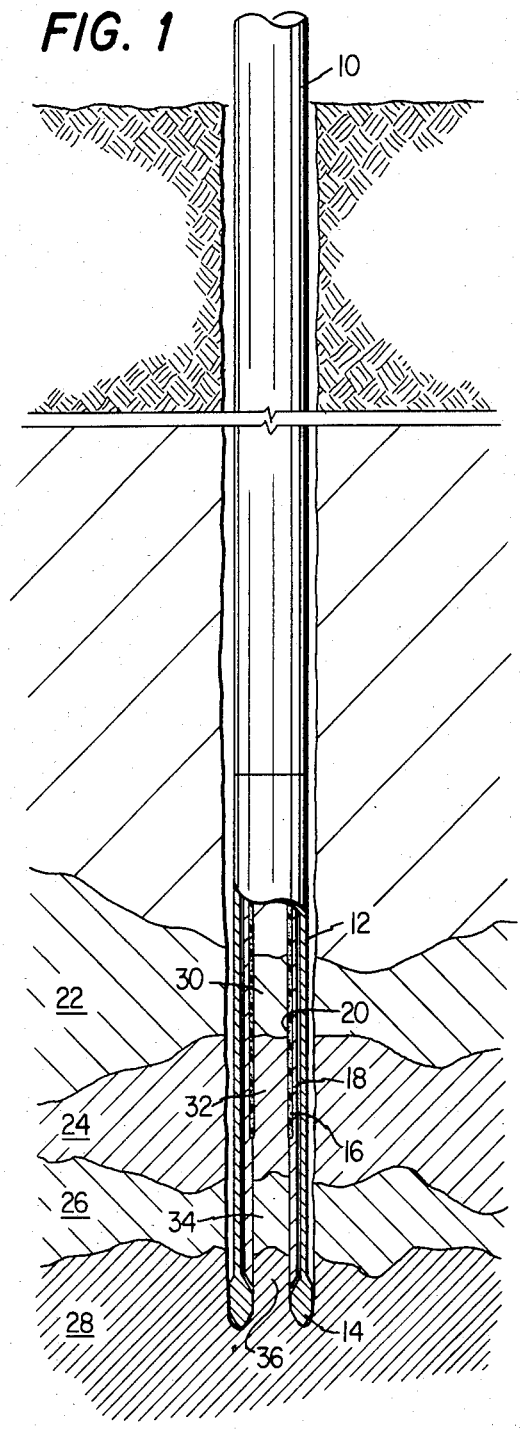
FIG. 1 illustrates a cross-sectional view of a coring drill penetrating a formation of interest.

Referring now to FIG. 1, there is illustrated a cross-sectional diagram of a coring apparatus extracting a core from a formation of interest. The coring procedure can utilize any conventional type of coring procedure and, in the preferred embodiment, sponge coring is utilized in accordance with the method disclosed in U.S. Pat. No. 4,312,414 issued to Arthur Park, one of the present Applicants.

In initiating a coring procedure, an operator examines the drilling fluid that exits the well to determine the point at which a formation of interest has been reached. In addition, the speed of the drill may also indicate to the operator that a formation of interest has been reached. Once reached, the drill is retrieved from the well hole and a coring apparatus 10 inserted. The coring apparatus 10 is comprised of an outer barrel 12 to which a coring bit 14 is attached on the end thereof. An inner barrel 16 is disposed within the outer barrel 12 with a passageway 18 formed therebetween. The inner barrel 16 has a sponge 20 disposed on the inner surface thereof and is operable to receive a core. This coring device is described in U.S. Pat. No. 4,312,414, the body of which is incorporated herein by reference.

The first layer that may be incurred in a formation of interest is shale. In a conventional formation of interest, a number of layers may be present that consist of shale, limestone or sandstone. Typically, three or four layers can be observed. In the example illustrated in FIG. 1, the coring apparatus 10 extracts a core from a formation of interest that is comprised of a top layer 22 of a first material, an upper middle layer 24 of a different material, a lower middle layer 26 of another type of material and a bottom layer 28 of a separate material. Each of the layers 22–28 can be distinctly different materials, the parameters of which are defined by their individual porosities, permeabilities, oil content and water saturation, each of which will be described in more detail hereinbelow.

A core is formed by coring through the layers 22, 24, 26 and 28. This core is formed of an upper portion 30 corresponding to the upper layer 22, an upper middle portion 32 corresponding to the upper middle layer 24, a lower middle portion 34 corresponding to the lower middle layer 26 and a lower portion 36 corresponding to the bottom layer 28. Once the maximum length of the core has been received into the inner barrel 16, the core is broken off and captivated within the inner barrel and the coring apparatus 10 extracted from the well. The core is then transported to an appropriate facility and an analysis made of the various parameters of the core.

Figure 2:
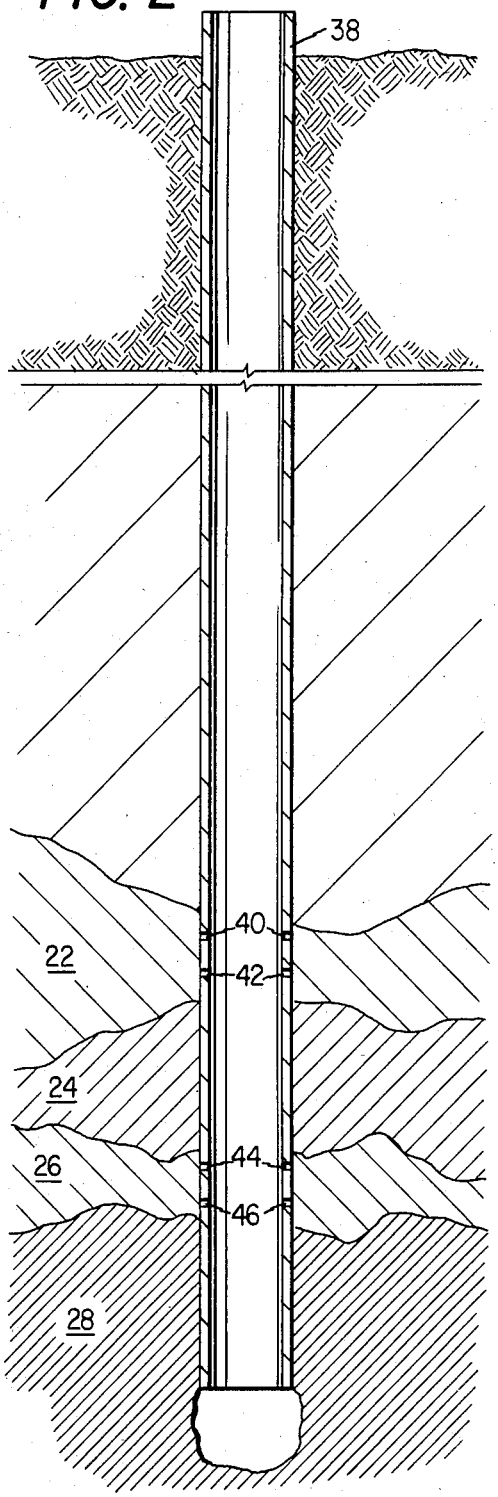
FIG. 2 illustrates a cross-sectional diagram of a well casing in place with perforations disposed in accordance with the method of the present invention.

After an analysis has been performed on the core, a determination is made as to whether the formation of interest has sufficient properties to warrant further investment in a pumping operation. If so, the drilled well is prepared for pumping, as illustrated in FIG. 2, wherein like numerals refer to like parts in the two FIGURES. A well casing 38 is lowered into the hole to provide a lining and support structure therefor. After the casing 38 has been lowered into the well, perforations are made in the sides thereof to allow fluid communication between the formation of interest and the interior of the well casing. Conventionally, a perforation gun is lowered into the casing with charges disposed along the length thereof. This perforation gun is operable to trigger these charges to produce a series of holes at a given depth. Typically, the perforations are located in one foot increments with approximately four perforations at a given depth increment. The perforations may range from one quarter to one-half inch in diameter. These perforations allow communication between the interior of the casing 38 and the formation proximate the perforations. In the conventional technique, these perforations are disposed along the entire surface of the well casing 38 proximate the formation of interest.

Once the perforations are located, the fluid flows as a result of either a high differential in pressure between the formation and the interior of the well casing 38, thus requiring no pumping action, or the application of a negative pressure within the well casing 38 to cause the fluid to flow from the formation and upwards to the surface.

In accordance with the present invention, the core extracted with the apparatus 10 is analyzed and a determination made as to which areas along the vertical axis of the well casing are most favorable for production purposes, as will be described hereinbelow. Once the most favorable areas are determined, the perforations are selectively placed at these areas. For example, as illustrated in FIG. 2, perforations 40 are disposed at one depth within the top level 22 and perforations 42 are disposed at another depth within the same layer 22. In addition, perforations 44 and perforations 46 are disposed proximate the lower middle layer 26 at various depths therein. By so disposing the perforations 40–46, flow from the upper middle layer 24 and the lower layer 28 is inhibited. As will be described hereinbelow, the reasons for this may be due to such things as low oil mobility, etc. Therefore, the production of a given well can be maximized. In addition to placement of the perforations, the selection of a given oil well as a function of its potential productivity can be more easily determined by utilizing the method in accordance with the present invention described hereinbelow. Hereinafter, the measure of productivity will be referred to as "Production Index", relative term.

To calculate the Production Index in accordance with the present invention, a number of parameters of the core must first be determined. These parameters are porosity, permeability, oil saturation in the core, oil released from the core during the transition from the bottom of the well to the surface (hereinafter termed "mobile oil") and water saturation in the core. Each of these factors will be described and the method for determination thereof.

In order to measure the parameters of the core, the core must first be obtained with the sponge coring apparatus of FIG. 1. The core is then analyzed to determine the various properties. One of the properties determined is permeability. Permeability is defined as the capacity of a formation to transmit fluids with the unit of measurement thereof being the "darcy". One darcy is defined as that permeability permitting a fluid of one centipoise viscosity to flow at a rate of one cubic centimeter per second through a cross-sectional area of a square centimeter when the pressure gradient is one atmosphere per centimeter. The formula generally used to determine rock permeability is:

$$K = \frac{QU}{A(P/L)}$$

where:

K=permeability in darcies
Q=quantity of flow
U=viscosity of fluid
A=area of cross-section of core
L=length of core
P=applied fluid pressure.

The results of this equation is in milidarcies (1/1000 of a darcy).

Measured values using standard equipment range from a value as low as 0.1 milidarcies to as high as 20,000 milidarcies. Determination of permeability requires a method for measuring gas flow at the downstream end of a clean, dry core of known dimensions, knowledge of upstream and downstream pressures and a core holder to prevent gas bypassing of the sample. Normally, dry gas is utilized as a standard fluid for use in permeability determinations to minimize fluid-rock reaction for ease of measurement. The measurement of permeability is more clearly described in part II, chapter 12 of "Subsurface Geology, L. W. Leroy and D. O. Leroy (1977), entitled "Core Analysis".

Another parameter necessary for determination of the productivity of a potential site is porosity. Porosity of a porous material is that fraction of the bulk volume of the material occupied by void. It is the measure of reservoir storage capacity and often varies from 10 to 40 percent in sandstone and from 5 to 25 percent in limestone and dolostones. Pore spaces within a porous material vary in size from microscopic in sandstones and intergranular limestones to vugs, caverns, or fractures normally introduced by secondary processes. The determination of porosity requires the measurement of two of three variables of pore volume, bulk volume and grain volume.

Porosity is measured by techniques which include evacuation and pressure saturation with liquid, or pressure saturation of nonevacuated pore space with helium. The helium technique, which employs Boyle's Law, has advantages over other gases because its small molecule rapidly penetrates small pores and it is inert and not absorbed on rock surfaces as air may be. This technique provides the pore volume with the bulk volume being provided by calipering in applying appropriate mathematical formulas. In addition to the helium technique, the Summation of Fluids technique can be utilized to determine porosity. The Summation of Fluids technique can be found in "Summation of Fluids Porosity Technique", Wilbur M. Hensel, Jr., American Institute of Mining, Metalurgical and Petroleum Engineers (1980) presented at the 55th Annual Fall Technical Conference and Exhibition of the Society of Engineers of AIME, Dallas, Tex., September 1980.

The oil saturation in the core is also a parameter required to calculate the production Index. Oil saturation and fluid saturation in general can be determined by a number of methods. One method is vacuum distillation where high vacuum and a temperature of 450° F. are utilized to recover oil and water. A second method is distillation extraction where water is distilled and oil extracted by appropriate solvents. A third method is the retort method at atmosphere pressure with temperatures up to approximately 1200° F. A the fourth method is the combination technique in formations containing hydratable clays. Fluid saturation obtained by the above methods is reported as a percent of the pore volume, and the magnitude reflects initial reservoir fluid content as well as the various conditions imposed during core recovery. These techniques will be described in more detail hereinbelow.

Vacuum distillation requires a leakproof system so that no extraneous air with associated moisture can be drawn in to the catch flask. Recovered fluids are condensed in a low temperature bath. Low API gravity oils are only partially recovered by this technique resulting in low saturations and porosities. All water is recovered, leaving any residual oil on the pore walls to influence core wetability, and will likely render these samples oil-wet.

The distillation extraction technique requires total weight loss measurement before and after cleaning of the sample, and measured water volumes determined during the distillation. Oil saturation is determined indirectly by difference. This technique requires knowledge of oil gravity so that weight loss can be converted to oil volume.

High temperature retorting yields a direct measurement of oil volume, and requires a calibration curve to relate recovered volumes to those present in the core. Incorrect calibration yields an incorrect oil saturation. A gasket is normally utilized to properly seal the cap for analysis to reduce the correction required. Pore water content must be determined from a plateau on the water recovery curve and this may be difficult to determine on samples containing hydratable clays.

The oil saturation that is determined indicates the percent of pore space which is occupied by oil in the core. In addition to determining the percentage of oil in the core, it is also necessary to determine the percentage of oil which has leaked from the core during removal of the core from the high pressure depths of the well to the surface. For this purpose, a sponge is utilized around the core to trap this residual oil as disclosed in U.S. Pat. No. 4,312,414, which was incorporated herein by reference. The sponge is then analyzed for oil content to determine the amount of oil absorbed thereby. When both the oil saturation of the core sample and the oil absorbed by the sponge are determined, the total amount of oil that was in the core at the bottom of the well can be determined. The oil that moves from the core to the sponge, as described above, is termed "mobile oil".

In order to determine the optimum production areas in a given well hole, it is necessary to determine where the "free" oil exists. In addition, it may also be necessary to determine where salt water production will be maximum so as to minimize the number of perforations in the well casing that will be placed in high salt water production areas. This is important in that production of salt water increases pumping and disposal costs as well as increasing the possibility of corrosion. Elimination of this will maximize oil productivity and minimize production costs.

Figure 3:
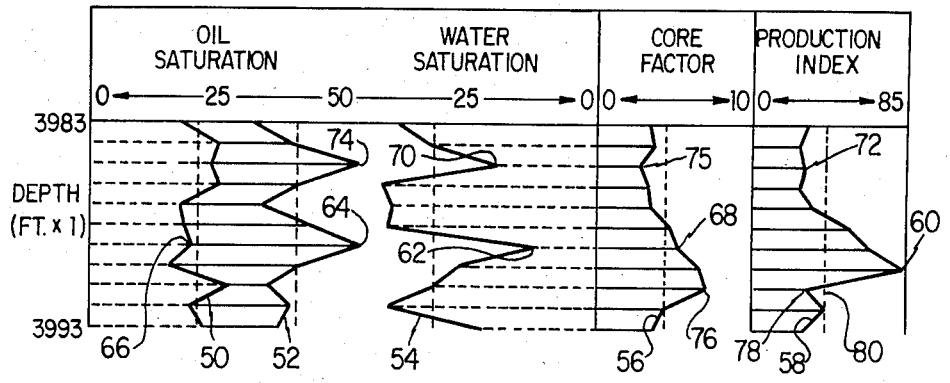
FIG. 3 illustrates a graph depicting a plot of oil saturation, water saturation, core factor and production index calculated in accordance with the method of the present invention.

Referring now to FIG. 3, there is illustrated a graph of the measured parameters from a core extracted from a well with sponge coring techniques. The parameters are plotted as a function of depth on the ordinate axis and respective parameter values on the abscissa. Oil saturation is divided into oil saturation in the core, oil saturation in the sponge as a result of oil that bleeds from the core and total oil saturation. The core oil saturation is represented by a graph 50 and the total oil saturation is represented by a graph 52. The amount of oil in the sponge is represented by the difference between the graphs 50 and 52. The depth is scaled in one foot increments from a depth of 3,983 feet to a depth of 3,993 feet for a 10 foot section of the core. However, it should be understood that the 10 foot section is for illustrative purposes only and that a single core length is approximately 30 feet and that up to 400 feet of core can be extracted in 30 foot lengths for analysis thereof.

The oil saturation curve 50, as described above, represents the percentage of pore space that is occupied by oil in the core, with the total oil on the curve 52 representing the percentage of oil in the core with respect to the oil adsorbed in the sponge. Therefore, the curve 52 provides an indication of the total oil that was initially stored in the core at the bottom of the well as a fraction of the pore space. The percent mobile oil is represented by the percent of oil in the pore column absorbed by the sponge divided by the total percentage of pore space occupied by oil. This represents the "free oil" that was in the core at the bottom of the well.

The water saturation of the core is represented by a curve 54 with the abscissa calibrated in percentage points. The direction of increase for the percentage of the curve 54 is in a direction opposite to that of the percentage increase of the curves 50 and 52 for comparison purposes only.

A curve 56 is plotted adjacent the curve 54 with an ordinate value ranging from zero to ten. The curve 56 represents the "Core Factor". The core factor is a term that provides an indication of the space available in the core for production. The Core Factor is equal to the square root of the maximum permeability times the porosity. The porosity in the preferred embodiment is measured with helium. A curve 58 is plotted adjacent the Core Factor curve 56 and represents the Production Index. The Production Index is equal to the Core Factor times the percent of mobile oil. The Production Index qualitatively determines those zones which have the highest probability to produce oil. The larger the Production Index, the more attractive the zone for perforations or stimulation. In order to provide a more readable graph for Production Index, the Production Index is increased by 0.5 to insure that it can never equal zero, divided by a scaling constant and integerized. In the preferred embodiment, the scaling factor is five. For example, an initial Production Index of 5.5 will be graphed as 1.0 and a Production Index of 11.5 will be graphed as 2.0.

The equation for Production Index is as follows:

$$PI = CF \times MO$$

where:

PI = Production Index

CF = Core Factor

MO = Percent Mobile Oil

The Core Factor is defined by the following equation:

$$CF = \sqrt{PERM \times POR}$$

where:

CF = Core Factor

PERM = Maximum Permeability

POR = Helium Porosity

Therefore, the Production Index or the capability to produce oil is a function of three factors, permeability, porosity and percent mobile oil. Although the Production Index has been defined in terms of percent mobile oil multiplied by the square root of the product of the permeability and porosity, it is not necessary that this exact equation be used. The equation only sets the relation between the parameters. For example, the product of the permeability and porosity could be multiplied by the square of the percent mobile oil. Depending upon the equation chosen for defining the relationship of the various parameters, the shape of the graph of Production Index can be changed to reflect this relationship.

Referring further to FIG. 3, the graphs will be described in more detail. As can be seen from the curve 58, the Production Index peaks at a point 60 thereon. This point corresponds to a depth of 3,990 feet. At this depth, the water saturation on the curve 54 is approximately 12 percent as represented by a point 62 and the total oil produced is approximately 52 percent, as represented by a point 64 on the curve 52. The oil saturation in the sponge is approximately 22 percent, as represented by a point 66 on the curve 50 with the percent oil saturation in the sponge equaling approximately 30 percent, which is the difference between the points 64 and 66. Therefore, the present mobile oil is the oil saturation in the sponge divided by the total oil or approximately 58 percent. The core factor at this depth is approximately 6.0, as represented by a point 68 on the curve 56. These values are inserted into the above equation for Production Index to yield the value for the point 60 of approximately 85.0.

In addition to permeability, porosity and percent mobile oil, another parameter that affects oil production is water saturation. The Production Index equation, as defined above can be modified to account for water saturation by the following equation:

$$PI = \frac{(CF \times MO)}{(SW/100)^4}$$

where:

SW = percent water saturation

This equation varies the Production Index inversely with respect to the water saturation raised to the fourth power. As described above, this equation can also be changed to vary the relationship between the parameters by, for example, raising the water saturation to the second power.

As can be seen from the curves 50–58 in FIG. 3, the Production Index is maximum where the percent mobile oil and Core Factor are maximum with the water saturation at a minimum. It is necessary to utilize all of these factors to determine the potential productivity of a well since any of them individually do not necessarily indicate production potential. For example, the water saturation has a second minimum at a point 70 on the curve 54 with a value of approximately 23 percent which corresponds to a Production Index of approximately 40, as represented by a point 72 on the curve 58. This also corresponds to a peak in the total oil, as represented by a point 74 on the curve 52. However, the Core Factor is at a minimum, as represented by a point 75 on the curve 56. Therefore, taking only a low water saturation and a high total oil saturation would not necessarily yield the best Production Index. In addition, the Core Factor by itself does not provide an adequate indication of the producibility of the well. For example, the peak of the Core Factor occurs at a depth of 3,991 feet, as represented by a point 76 on the curve 56. This corresponds to a Production Index of approximately 40.0 as represented by a point 78 on the curve 58. Therefore, it is first necessary to determine the percent mobile oil by utilizing sponge coring techniques, the porosity and permeability of the core and also the percent water saturation. With these three factors, a Production Index can be determined that will provide an indication of the producibility of the well.

In determining whether to drill the well, the first determination to be made is whether the well will produce at any depth in the formation of interest. This is determined by developing a criteria as to the overall average of the Production Index. In the graph of FIG. 3, the average is represented by a dashed line 80 through the curve 58. Once the average has been calculated, a determination can be made as to the overall producibility of a given formation of interest. This determination is generally a subjective determination made by the drilling company and usually requires some further testing as to preliminary well flow etc. However, after the decision to proceed is made, the placement of the perforations must then be determined. This is determined by the values of the production index that are above the average value. If the perforations are made in these zones, a higher production rate will result due to the high percentage of mobile oil and the costs will be increased due to the lower percentage of water saturation at that point.

Figure 4:
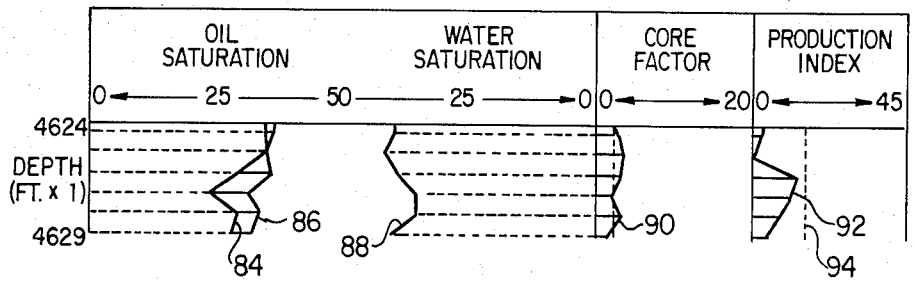
FIG. 4 illustrates a graph similar to the graph of FIG. 3 in a formation that has oil that is not mobile.

Referring now to FIG. 4, there is illustrated a graph for a formation of interest in which the zone illustrated has a core factor that indicates a good quality rock but with a low percentage of mobile oil. The core sample was taken between a depth of 4,624 feet and a depth of 4,629 feet in one foot increments. The oil saturation is represented by a curve 84 and the total oil is represented by a curve 86. As described above, the percentage of the oil in the pore column that is absorbed by the sponge is represented by the space between the curves 84 and 86 for a given depth. The water saturation is represented by a curve 88 and the core factor is represented by a curve 90. The Production Index is represented by a curve 92. The ordinate axes are calibrated similar to the ordinate axes of the graph of FIG. 3.

The curve of FIG. 4 illustrates that even with a total oil saturation in the 20–42 percent range, a large percentage of water would probably be produced. This is due to the fact that there is a very small percentage of mobile oil and, therefore, the core factor consisting of the porosity and permeability cannot be relied on by itself. For example, the core factor at the depth of 4,625 feet has a value of 3.33, the oil saturation in the core has a value of 34 percent and the total oil saturation also has a value of 34 percent with the percentage of oil absorbed by the sponge equaling 0 percent. The water saturation is 40.4 percent. With the percent mobile oil equal to 0 percent, the production index is also equal to 0, thereby indicating a very poor producibility for this particular depth. This is due to the high water content of the formation of interest at that depth.

In reviewing the overall Production Index for the given well represented by the core sample graphed in FIG. 4, the highest value obtained is 12.0 at a depth of 4,626 feet. Depending upon the criteria used by a particular drilling company, this Production Index would generally indicate that the well had a low producibility. This criteria can be placed onto the graph, as indicated by a dashed line 94 which indicates the threshold which the Production Index must exceed to warrant placing perforations in this particular zone. Although only one zone was illustrated, it is possible that further zones at different depths within a given coring operation will have distinctly different Production Indexes.

Figure 5:
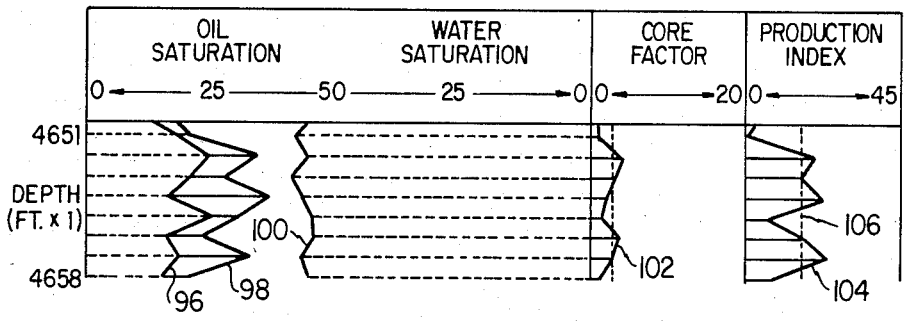
FIG. 5 illustrates a graph similar to the graph of FIG. 3 for a formation that has a high degree of both water saturation and mobile oil.

Referring now to FIG. 5, there is illustrated a graph of a core sample illustrating a zone that has a large amount of oil that was absorbed by the sponge with a high degree of mobility. This zone would show a high probability of producing oil. The ordinate of the axis in the graph of FIG. 5 is calibrated in feet and ranges between 4,651 feet to 4,658 feet in one foot increments. A curve 96 represents the oil saturation in the core and a curve 98 represents the total oil with the oil saturation in the sponge represented by the space therebetween. A curve 100 represents the water saturation in percentage. The curves 96, 98 and 100 are plotted similar to the graphs of FIGS. 3 and 4.

A curve 102 represents the core factor and is plotted on an ordinate axis scaled from 0 to 20 and a curve 104 represents the Production Index which has an ordinate axis scaled from 0 to 45. A dashed line 106 represents the threshold over which the Production Index must exceed in order to place perforations in this zone. As can be seen from the curve 104, the Production Index exceeds the dashed line 106 at the depths 4,652, 4,654 and 4,657 feet. Although the water saturation is in the excess of 50 percent for the total core sample illustrated, the Production Index is still above the threshold 106 due to the high percentage of mobile oil in the core sample. For example, at the depth of 4,657 feet, the percentage of oil in the core is 19.2 percent, the percentage of the oil in the sponge is 13.0 percent with the total oil being equal to 32.2 percent. The core fator has a value of 2.67 with the water saturation equal to 56.5 percent. By applying the above equations, the Production Index is equal to 22.0. This exceeds the threshold 106, which is approximately 14.

The Production Index in the curve of FIG. 5 is much larger than the Production Index in the curve of FIG. 4. However, there is less water saturation in the sample of FIG. 4 as compared to the same of FIG. 5. However, in comparing the Core Factor between the two samples of FIGS. 4 and 5, the Core Factor of FIG. 4 has larger values ranging from a minimum of approximately 1.32 to a maximum of approximately 3.33 whereas the Core Factor of FIG. 5 ranges from a minimum of 0.54 to a maximum 3.49. Therefore, the percent mobile oil provides a more realistic view of the producibility of the well when calculated into the Production Index. By examining the data from two core samples with the use of the Production Index, a more exact placement of the perforations can be made within a well casing to prevent placement at low production sites or placement at sites that would produce a great deal of water in addition to oil. In this manner, production rates can be increased and production costs decreased.

Figure 6:
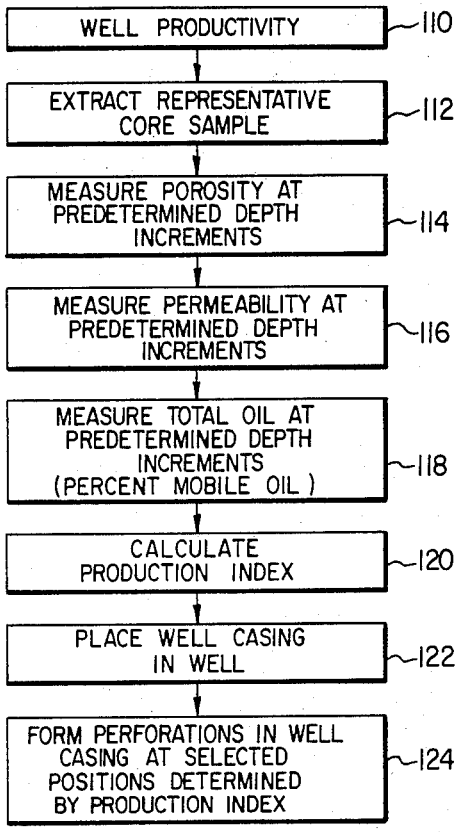
FIG. 6, illustrates a flow chart of the method of the present invention.

Referring now to FIG. 6, there is illustrated a flow chart for generating the Productivity Index and placing perforations in the well casing. The flow chart is labeled in a block 110 as "Well Productivity." The flow chart then flows to a block 112 to indicate extraction of a representative core sample. The flow chart then proceeds to a function block 114 wherein the porosity of the core sample is measured at predetermined depth increments. The program then flows to a function block 116 wherein the permeability of the core sample at the predetermined depth increments is measured. The program then flows to a function block 118 wherein the percent mobile oil is measured. This information is then utilized in a function block 120 to calculate the production index, as described hereinabove. This calculated production index is then utilized to place perforations in the well casing. The well casing is placed in the well, as indicated by function block 122, and then the perforations are placed in the selected positions in the well casing, as indicated by function block 124.

In summary, there has been provided a method for determining placement of perforations within a well casing along the axis thereof. The method is comprised of first extracting a core from a formation of interest and examining this core for permeability, porosity and the percentage of mobile oil that was in the core prior to extraction. The permeability and porosity are combined as the square root of a product of the two parameters and termed the Core Factor. This is multiplied by the percent mobile oil to provide the Production Index. The Production Index is the capacity of the oil well to produce oil at the given perforation sites. Therefore, perforations can be selectively placed at different layers in a given formation of interest.

Although the perferred embodiment has been described in detail, it should be understood that various changes, substitutions and alterations can be made therein without departing from the spirit and scope of the invention as defined by the appended claims.

What is claimed is:

1. A method for determining the productivity of a well site, comprising:

extracting a representative core sample of a formation of interest from the well site utilizing sponge coring techniques, the portion of the total oil that bleeds out of the core sample absorbed by the sponge utilized in sponge coring techniques;

measuring the porosity of the core sample at predetermined depth increments;

measuring the fraction of the core space in the core sample occupied by total oil at each of the predetermined depth increments, the total oil equal to the oil remaining in the core on the surface of the well in addition to the oil that bleeds out of the core sample upon extraction thereof, the fraction equal to the percent mobile oil;

determining a Production Index to indicate the producibility of the well as a function of depth increments, the Production Index varying directly with the product of the porosity, permeability and percent mobile oil; and placing a well casing in a well that is disposed in the formation of interest and placing perforations in the well casing at selected positions determined by the Production Index such that the selected perforations are located at depths having a Production Index greater than a predetermined number along the formation of interest.

2. The method of claim 1 and further comprising determining the percent of water saturation in the core.

3. The method of claim 2 wherein the Production Index further varies inversely with respect to the water saturation.

4. The method of claim 1 wherein the Production Index is equal to the square root of the product of the permeability and porosity multiplied by the percent mobile oil.

5. A method for determining the productivity of a well site, comprising:

extracting a representative core sample of a formation of interest from the well with sponge coring techniques such that the sponge traps fluids that bleed off from the core samples;

measuring the porosity of the core sample at predetermined depth increments;

measuring the permeability of the core sample at each of the predetermined depth increments;

measuring the oil saturation in the core sample at the predetermined depth increments, the oil saturation equal to the percent of the pore space of the core sample which is occupied by oil;

measuring the percentage of oil in the pore space absorbed by the sponge at each of the predetermined depth increments;

calculating the total percentage of oil saturation which is equal to the sum of the oil in the core plus the oil in the sponge as a percent of the pore space of the core sample at the predetermined depth increments;

calculating percent mobile oil, the percent mobile oil equaling the fraction of the total percentage of oil saturation that is absorbed by the sponge as a percentage;

calculating a core factor, the core factor equaling the square root of the product of the porosity times the permeability;

calculating the Production Index, the Production Index equaling the product of the core factor and the percent mobile oil;

the Production Index providing an indication of the producibility of a well, a high value for the Production Index indicating a more producible zone than a low value;

placing a well casing in the well; and disposing perforations in the walls of the well casing as a function of peaks in the Production Index where the value of the Production Index is greater than a predetermined value.

6. The method of claim 5 and further comprising measuring the water saturation of the core sample at the predetermined depth increments and calculating the Productivity Index to equal the product of the core factor and the percent mobile oil divided by the percent water saturation.

7. A method for placement of perforations in a well casing to maximize producibility in a well site, comprising:

extracting a representative core sample of a formation of interest in the well;

measuring the porosity of the core sample at predetermined depth increments;

measuring the permeability of the core sample at each of the predetermined depth increments;

measuring the fraction for the pore space in the core sample occupied by total oil at each of the predetermined depths, the total oil equal to the oil remaining in the core on the surface of the well in addition to the oil that bleeds out of the core sample upon extraction thereof, the fraction equal to the percent mobile oil;

determining a Production Index to indicate the productivity of the well, the Production Index varying directly with the product of porosity, permeability and percent mobile oil and as a function of the predetermined depth increments;

placing a well casing in the well; and perforating the well casing at locations determined by the Production Index such that the perforations are placed at depths having a Production Index that is greater than a predetermined value such that perforations are located proximate peaks in the value of the production index rather than valleys in the value thereof.

8. The method of claim 7 wherein the step of extracting a representative core sample comprises utilizing sponge coring technique with a sponge disposed around the core such that the portion of the total oil that bleeds out of the core sample is absorbed by the sponge.

9. The method of claim 7 and further comprising determining the percent of water saturation in the core.

10. The method of claim 7 wherein the Production Index further varies inversely with respect to the water saturation of the core.

11. The method of claim 7 wherein the Production Index is equal to the square root of the product of the permeability and porosity multiplied by the percent mobile oil.

12. A method for placement of perforations in a well casing to maximize production in a well site, comprising:

extracting a representative core sample of a formation of interest from the well with sponge coring techniques such that the sponge utilized in the sponge coring techniques traps fluids that bleed off from the core samples as a result of removing the core sample from a high pressure region at the depths of the well to a low pressure region at the service of the well;

measuring the porosity of the core sample at predetermined depth increments along its longitudinal axis;

measuring the permeability of the core sample at each of the predetermined depth increments;

measuring the oil saturation in the core sample at the predetermined depths, the oil saturation equal to the percent of the pore space of the core sample which is occupied by oil;

measuring the percentage of oil in the pore space absorbed by the sponge at each of the predetermined depth increments;

calculating the total percentage of oil saturation which is equal to the sum of the oil in the core plus the oil in the sponge as a percent of the pore space of the core sample at the predetermined depth increments;

calculating percent mobile oil, the percent mobile oil equaling the fraction of the total oil saturation that bleeds into the sponge as a percentage;

calculating a core factor, the core factor equaling the square root of the product of the porosity times the permeability;

calculating the Productivity Index, the Productivity Index equaling the product of the core factor and the percent mobile oil;

the Production Index providing an indication of the productivity of a well, a high value for the Production Index indicating a more producible zone than a low value;

placing a well casing in the well; and perforating the well casing at locations determined by the Production Index such that the perforations are placed at depths having a Production Index that is greater than a predetermined value such that perforations are located proximate peaks in the value of the Production Index rather than valleys in the value thereof.

13. The method of claim 12 and further comprsing measuring the water saturation of the core sample at the predetermined depth increments and calculating the Productivity Index to equal the product of the core factor and the percent mobile oil divided by the product of the percent water saturation and a constant.

* * * * *